US010632637B2

(12) United States Patent
Rother

(10) Patent No.: US 10,632,637 B2
(45) Date of Patent: Apr. 28, 2020

(54) FOOD PROCESSING APPARATUS AND METHOD FOR SEQUENTIALLY SCANNING FOOD PRODUCTS

(71) Applicant: Weber Maschinenbau GmbH Breidenbach, Breidenbach (DE)

(72) Inventor: Ingo Rother, Breidenbach (DE)

(73) Assignee: WEBER MASCHINENBAU GMBH BREIDENBACH, Breidenbach (DE)

( * ) Notice: Subject to any disclaimer, the term of this patent is extended or adjusted under 35 U.S.C. 154(b) by 476 days.

(21) Appl. No.: 14/033,046

(22) Filed: Sep. 20, 2013

(65) Prior Publication Data

US 2014/0083268 A1 Mar. 27, 2014

(30) Foreign Application Priority Data

Sep. 21, 2012 (DE) ..... 10 2012 018 754

(51) Int. Cl.

| | |
|---|---|
| ***B26D 5/00*** | (2006.01) |
| ***B26D 5/20*** | (2006.01) |
| ***B26D 5/32*** | (2006.01) |
| ***B26D 7/06*** | (2006.01) |
| ***B26D 7/32*** | (2006.01) |

(52) U.S. Cl.

CPC ..... *B26D 5/007* (2013.01); *B26D 5/20* (2013.01); *B26D 5/32* (2013.01); *B26D 7/0625* (2013.01);

(Continued)

(58) Field of Classification Search

CPC .... B23D 23/00; B23D 47/045; B23D 55/046; B26D 5/007; B26D 5/20; B26D 5/32;

(Continued)

(56) References Cited

U.S. PATENT DOCUMENTS 3,485,339 A * 12/1969 Miller ..... B65G 43/08 198/460.1
4,099,059 A * 7/1978 Distler ..... A61B 6/04 378/17

(Continued)

FOREIGN PATENT DOCUMENTS

DE 10342499 A1 4/2005
DE 102010034674 A1 * 2/2012 ..... A22C 17/0033

(Continued)

OTHER PUBLICATIONS

German Search Report dated Jul. 23, 2013; 5 pages.

*Primary Examiner* — Kenneth E Peterson
*Assistant Examiner* — Liang Dong
(74) *Attorney, Agent, or Firm* — Brooks Kushman P.C.

(57) ABSTRACT

The disclosure relates to a food processing apparatus with a scanner for determining properties of a food product, in particular a food bar, with at least two substantially parallel separately drivable conveyor tracks for supplying the food products to the scanner, and with a control unit for controlling the drive of the conveyor tracks. According to the disclosure, the control unit is adapted to separately control the drive of the conveyor tracks to convey at least one food product of a first conveyor track and at least one food product of a further conveyor track sequentially through a scanning area of the scanner. The disclosure further relates to a method for scanning food products.

25 Claims, 3 Drawing Sheets

(52) U.S. Cl.
CPC ..... *B26D 7/32* (2013.01); *Y10T 83/0586* (2015.04); *Y10T 83/182* (2015.04); *Y10T 83/536* (2015.04)

(58) Field of Classification Search
CPC ..... B26D 7/0625; B26D 7/32; Y10T 83/0586; Y10T 83/182
USPC ..... 83/52, 155, 732, 435.2, 370, 371, 74, 83/75.5; 198/575, 577, 445
See application file for complete search history.

(56) References Cited

U.S. PATENT DOCUMENTS 5,711,410 A * 1/1998 Cai ..... B65G 43/08 198/460.1
6,407,818 B1 * 6/2002 Whitehouse ..... B26D 7/30 250/559.21
7,997,046 B2 * 8/2011 Salvoni ..... B65G 47/31 198/464.3
2005/0132855 A1 * 6/2005 Weber ..... B26D 9/00 83/155
2006/0154587 A1 * 7/2006 Mikkelsen ..... A22C 17/0086 452/150
2006/0156878 A1 * 7/2006 Faires ..... A22C 7/00 83/13
2006/0261157 A1 * 11/2006 Ostrowski ..... A47F 11/10 235/383
2008/0302607 A1 * 12/2008 Kaplan ..... A47F 9/04 186/61
2009/0090583 A1 * 4/2009 Bonner ..... G06Q 30/06 186/59
2012/0042757 A1 * 2/2012 Weber ..... B26D 5/20 83/23
2012/0073415 A1 * 3/2012 Maidel ..... B26D 1/143 83/13
2012/0167730 A1 * 7/2012 Schaub ..... B26D 7/30 83/39

FOREIGN PATENT DOCUMENTS

DE 102010034674 A1 2/2012
WO WO-2010112239 A2 10/2010

* cited by examiner

FOOD PROCESSING APPARATUS AND METHOD FOR SEQUENTIALLY SCANNING FOOD PRODUCTS

CROSS-REFERENCE TO RELATED APPLICATIONS

This application claims priority to German Patent Application 10 2012 018 754.8 filed on Sep. 21, 2012, which is hereby incorporated by reference in its entirety.

TECHNICAL FIELD

The present disclosure relates to a food processing apparatus with a scanner for determining properties of a food product, especially a food bar, where at least two substantially parallel separately drivable conveyor tracks are provided for supplying the food products to the scanner, and a control unit for controlling the drive of the conveyor tracks. The disclosure further relates to a method for scanning food products, wherein several food products are arranged on at least two substantially parallel conveyor tracks.

BACKGROUND

From the generic German patent application DE 10 2010 034 674 A1, a method for simultaneous multi-track slicing of several food products is known, wherein a common product scanner is provided which extends transversely to the conveying direction across all tracks. The product scanner is operated by the use of X-rays and simultaneously irradiates several food products being disposed on different parallel tracks.

Furthermore, a method for generating weight-specific food portions is known from DE 10 2005 010 183 A1, wherein several food bars are simultaneously irradiated prior to slicing, and wherein during irradiation of the respective food bar, there is preferably a certain distance food between the food bars.

It is known from DE 101 46 155 A1 to have a sensor in the form of a scanner be provided above the supply belt of an automated cutting device for cutting food products, with the aid of which the width of the individual products, or alternatively, the total width of the adjacently positioned products can be determined, where the products are passed through the sensor in parallel and at the same time.

The above scanners, however, are expensive because they must be designed relatively large to irradiate the products. Furthermore, when using X-rays for scanning, a certain distance must advantageously be maintained between the products, as there may otherwise be interactions between the values measured for each product. This is achieved, for example, in that a certain distance is maintained between the individual conveyor tracks in the scanner. Before the products are supplied to a common downstream cutting device, however, they must usually again be moved back closer together so that they can be sliced by a common cutting blade.

Several food products can be weighed together after scanning, where the individual weight of each food product is then calculated using the properties of the individual products determined during scanning, for example, using the volume of individual products or the area sums of various receptacles of the individual product.

SUMMARY

It is the object of the present disclosure, to provide a food processing apparatus and a method for scanning food products, which allow a plurality of food products, which are disposed on substantially parallel, separately drivable conveyor tracks, to be scanned efficiently and with high accuracy.

This is achieved by a food processing apparatus with a scanner with a scanning unit for determining properties of a food product, in particular a food bar, at least two substantially parallel separately drivable conveyor tracks for supplying the food products to the scanner, and a control unit for controlling the drive of the conveyor tracks, where the control unit is adapted to separately control the conveyor tracks to convey at least one food product of a first conveyor track and at least one food product of a further conveyor track sequentially through a scanning area of the scanner.

Due to the fact that not all food products of the conveyor tracks are conveyed simultaneously through the scanning area of the scanner, it is possible to avoid negative interaction between the products, in particular shielding, as it can occur for joint scanning. Furthermore, the individual conveyor tracks can be brought closer together, or must not be located at a distance in sections of the scanning area.

It is possible that a sub-group of conveyor tracks, such as every second conveyor track in the transverse direction, simultaneously conveys its food products through the scanning area of the scanner, where the other conveyor tracks convey their food products subsequently through the scanner. Thereby, the distance between the conveyor tracks can at higher quality scanning be selected closer than in prior art. The food products are provided primarily individually lined up in the conveying direction on the respective conveyor tracks. The food products can directly adjoin each other in the conveying direction, or be spaced apart from each other. In some embodiments, however, it is also possible that two or more parallel food products are arranged on one conveyor track.

The food products are in particular food bars in the form of sausage bars, cheese bars, or ham bars. These food bars can in particular have a uniform shape in the longitudinal and the conveying direction. However, the food products can also be food products shaped irregularly in the longitudinal and the conveying direction, such as naturally shaped pieces of ham.

Specifically, the substantially parallel separately drivable conveyor tracks are adapted for conveying the individual food products through the scanning area. Alternatively, the parallel conveyor tracks can also be only outside the scanner.

The control unit is in particular adapted to individually convey the food products through the scanning area. Consequently, there is no interaction between the different scans of the food products. Thereby, the size and the output of the scanning unit in the scanner are comparatively low, which allows the scanner to be economically designed and operated.

The scanning unit is in particular a radiographic device. Alternatively, an optical scanner, such as a digital camera or a line camera, can be used with which higher evaluation accuracy can be achieved with little effort, if not all food products are scanned at once. In particular, the use of sonography units is possible in the scanner for analyzing the inside of the food products.

The radiographic device advantageously comprises at least an X-ray source and at least one associated detector. In particular, a plurality of X-ray sources and exactly one associated detector can be provided, exactly one X-ray source and a plurality of associated detectors, or even a plurality of X-ray sources and a plurality of associated detectors. The X-ray scanning with at least one X-ray source and at least one associated detector is usually significantly faster than optical scanning, in particular, one scan of a food product 1 m to 3 m in length requires only about 1 second to 3 seconds.

Advantageously, the scanner is moveable. The scanning unit is movable primarily only in the scanning area and in particular in the scanning plane of the scanner. Thereby the scanning unit can respectively be driven to the food product to be irradiated, where in particular an optimal arrangement of the scanning unit, or the X-ray source, respectively, and the associated detector to the respective food product can be achieved, so that an analysis of the food product can be performed at high quality.

In some embodiments, the scanning unit can be pivotable. This makes it possible, that the scanning unit can be exactly aligned to the at least one food product to be irradiated.

A movable or pivotable scanning unit is particularly advantageous for the use of X-ray radiation, as X-ray radiation cannot be optically bundled. Thereby, the at least one food product being present in the scanning area of the scanner can be specifically analyzed with an X-ray source having relatively low output. If the scanning unit comprises an image recording device, the alignment or the method, respectively, of the image recording unit, in particular in the form of a digital camera, can be performed exactly to the respective at least one food product so that it can be recorded in high resolution.

The beam axis of the scanning unit is in particular approximately vertical. With a scanning unit with an X-ray source, the beam axis refers to the beam central axis, as X-rays cannot be optically bundled and therefore fan out about the beam central axis.

Therefore, the scanning unit is primarily arranged such that the at least one food product is irradiated substantially vertically. An X-ray source is in particular disposed above the food product and the associated detector below the food product. Alternatively, an X-ray source is disposed below the food product and the associated detector above the food product. If the food product is irradiated vertically, it is particularly appropriate to have the scanning unit be substantially horizontally movable, in order to be moved sequentially to the various conveyor tracks on which the respective at least one food product is then arranged.

In another embodiment, the beam axis of the scanning unit is essentially horizontal. Here as well it is true, that for a scanning unit with an X-ray source, the beam axis refers to the central beam axis. Therefore, the scanning unit is arranged such that the at least one food product is irradiated primarily vertically. As the conveyor tracks in this arrangement are not located in the beam path, they can be guided through the scanning area without interruption.

In one embodiment, the conveyor tracks are associated with a weighing apparatus.

The conveyor tracks are in particular associated with a common weighing apparatus, where the weighing apparatus is adapted to determine the individual weight of the food products via a differential weight measurement during the sequential supply of food products of the first and the further conveyor tracks using the weight of the food products resting together on all conveyor tracks. After the food products of the various conveyor tracks are conveyed through the scanning area in a time-staggered manner, the individual weight of the food products can be determined by the differential measurement of the weight of the food products resting together on all conveyor tracks. Preferably, the weighing apparatus is disposed in the conveying direction downstream of the scanning area. The differential measurement is therefore always performed for the at least one food product that is conveyed by the weighing device from the scanning area to the conveyor tracks downstream of the scanning area. Alternatively, the weighing apparatus can be associated with the conveyor tracks being in the conveying direction upstream of the conveyor tracks. After at least one of the food products was passed by the weighing device through the scanning area, the weight of this at least one food product can then be determined by differential measurement.

In one embodiment, a food cutting apparatus is disposed downstream of the scanner, where the food products of the first and the further conveyor tracks are sliced altogether, based on the properties or values determined by the scanner. The food cutting apparatus is in particular a slicer. The slicer can be designed such that a plurality of food products supplied in parallel can be cut altogether by a cutting blade. The supply speed of the individual food products in the direction of the cutting blade can preferably be controlled individually. This can be done in particular based on the properties respectively determined by the scanner for the individual food products. The supply speed can in particular be increased when an area with a lower density of a food product is sliced in order to nevertheless maintain a predetermined portion weight.

In one embodiment, the detector can be arranged between the conveyor tracks. In particular, an X-ray source is disposed laterally adjacent to the conveyor tracks, where one detector is respectively arranged in the transverse direction between the conveyor track on which the food product to be irradiated is conveyed, and the conveyor track downstream in the beam direction. Thereby, a small distance can be maintained between the detector and the food product, resulting in a reduced size of the detector and an improvement of the scanning result. The detectors can in particular each be moved substantially in the vertical direction in order to be used for scanning, or to be removed out of the X-ray beam, respectively, when a food product is scanned on different conveyor track with a different detector.

In one embodiment, the scanning unit is disposed on a support which is mounted pivotable about at least one conveyor track. The pivot axis of the scanning unit is in particular substantially parallel to the conveyor tracks. By pivoting the scanning unit, at least one of the food products can specifically be scanned. If the scanner is a radiographic device, then this makes it possible that the detector and the beam of the radiographic device can be designed to be relatively small, since the scanning unit is respectively pivoted exactly such that only that food product is scanned which is presently conveyed through the scanning area.

The respective conveyor tracks can be respectively subdivided into a conveyor track upstream of the scanning area and a conveyor track downstream of the scanning area, where the scanning area is defined in its distance between the conveyor tracks. Any negative influence upon the scanning area by the conveyor tracks, and in particular by their conveyor devices, such as conveyor belts, can thereby be prevented.

Alternatively, a conveyor device of the conveyor tracks can extend through the scanning area. In particular, the conveyor devices of all conveyor tracks can extend through the scanning area. In this embodiment, predominantly conveyor belts, in particular belts that can be irradiated at least by X-ray radiation without significantly distorting the scan result, are suited as conveyor devices. A variant with a long belt is here in particular possible, comprising a first belt section upstream of the scanning area, a second belt section in the scanning area and a third belt section downstream of the scanning area. In this, in particular both the food product as well as at least the upper run of the belt band is irradiated. The third belt section may in particular constitute a cradle section which is associated with a weighing device. The uninterrupted conveyor device through the scanning area allows food product to be conveyed through the scanner without conveyor handling problems at transfer points, which is particularly important for small and delicate products.

The object of the disclosure is further satisfied by a method for scanning food products, with a scanner, wherein a plurality of food products is arranged on at least two substantially parallel conveyor tracks, and wherein each at least one food product of a first conveyor track and each at least one food product of a further conveyor track are sequentially conveyed through a scanning area of the scanner.

The scanner comprises in particular a scanning unit which can be a radiographic device, for example, an X-ray source and an associated detector, or also a digital image recording unit.

Advantageously, the food products are individually conveyed through the scanning area. Alternatively, a sub-group of the food products arranged in parallel upstream of the scanner can be conveyed through the scanning area. Due to the fact that not all food products are scanned simultaneously, a higher quality of measurement by the scanner can be obtained.

The scanner in particular comprises a scanning unit which is moved in dependency of the conveyor track on which the respective food product is resting. The scanner can in particular comprise precisely only one scanning unit. Since the scanning unit advantageously comprises an X-ray source, this can significantly reduce the costs and the safety requirements regarding the scanner. Alternatively, however, a plurality of scanner units can be provided, which can each or partially be moved. The X-ray source of the movable scanning unit must only produce a significantly lower output than an X-ray source which is designed to irradiate all food products at the same time. Thereby, the acquisition and operating costs for the food processing apparatus according to the disclosure are in comparison significantly reduced.

The food products are after scanning advantageously aligned regarding each other in the conveying direction. In particular, the leading ends of the food products are aligned to each other in the conveying direction, so that in particular parallel processing of the food products is possible.

The food products of the first and the further conveyor tracks are after scanning in particular sliced based on the properties determined during scanning. This is done in particular in a food cutter, advantageously in a slicer. Preferably, the food products are supplied simultaneously and in parallel to the food cutter and thereby sliced simultaneously. This can in particular be done by a cutting blade which cuts the food products altogether arranged in parallel.

The sequential scan can be upstream or downstream of a sequential weighing process of the food products. The sequential weighing process can be performed individually for each food product. Alternatively, during sequential weighing, the individual weight of the food products can be determined by the differential weighing determination.

The food products of the first and the further conveyor tracks can be sliced after scanning and weighing based on the properties determined during scanning and weighing.

The disclosure shall now be further explained using embodiments that are shown in the following figures.

DETAILED DESCRIPTION

Figure 1:
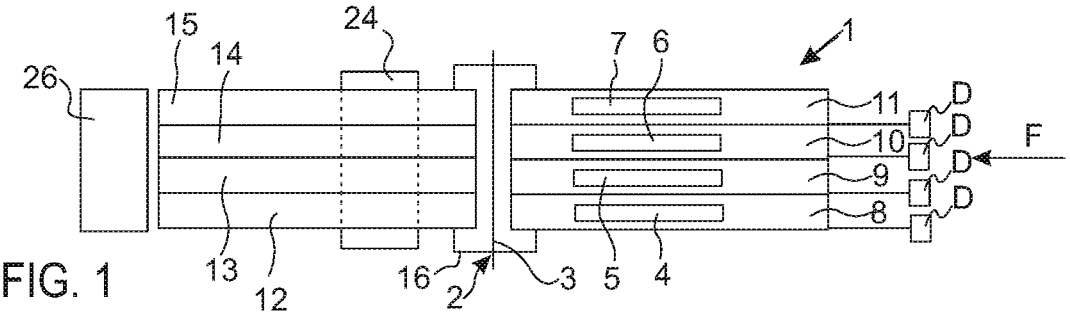
FIG. 1 shows a plan view of an embodiment of a food processing apparatus according to the disclosure, where the food products are arranged upstream of a scanning area of a scanner.

FIG. 1 shows an embodiment of a food processing apparatus 1 according to the disclosure in a plan view. The food processing apparatus 1 comprises a scanner 2 which can determine properties of food products 4, 5, 6, 7 in a scanning area 3. The scanning area 3 can in particular be defined as a scanning plane whose surface normal is defined by the conveying direction F of the food products 4, 5, 6, 7. The food products 4, 5, 6, 7 are initially arranged on the conveyor tracks 8, 9, 10, 11 upstream of the scanner 2.

The conveyor tracks 8, 9, 10, 11 are drivable individually, where a control unit is provided which can separately control the respective drive D of the individual conveyor tracks. Thereby, the food products 4, 5, 6, 7 can be conveyed separately on the upstream conveyor tracks 8, 9, 10, 11 in the conveying direction F. The conveyor tracks in particular comprise a conveyor belt for conveying the food products. In alternative embodiments, a pusher or gripper can also be provided which conveys the respective food products 4, 5, 6, 7.

Furthermore, conveyor tracks 12, 13, 14 are provided downstream of the scanner 15 which are associated with the respective upstream conveyor tracks 8, 9, 10, 11. This means, the respective conveyor tracks 12, 13, 14, 15 extend in particular at a short distance in the conveying direction F downstream of the conveyor tracks 8, 9, 10, 11, where the scanning area 3 is defined between the conveyor tracks. It can thereby be prevented that the scanner 2 during scanning of the food products 4, 5, 6, 7 is obstructed by the conveyor tracks 8, 9, 10, 11, 12, 13, 14, 15.

The conveyor tracks 8, 12 are synchronized in their conveying speed, in particular, mechanical synchronization of their drive can be provided. The same applies for the conveyor tracks 9 and 13, 10 and 14, and 11 and 15.

The scanner 2 comprises a housing 16 into which the conveyor tracks 8, 9, 10, 11 extend from the one side, and from which the conveyor tracks 12, 13, 14, 15 extend on the other side. The housing 16 is designed, in particular, to shield from X-ray radiation which is used for scanning in the scanner 2. For this purpose, the housing can be partially made of lead. In addition, the housing 16 can have attached shielding curtains covering the supply and discharge openings for the food products 4, 5, 6, 7. The housing 16 is in FIG. 1 shown relatively short in the conveying direction F, but can also extend over the entire or almost the entire length of the conveyor tracks arranged upstream and downstream.

Figure 2:
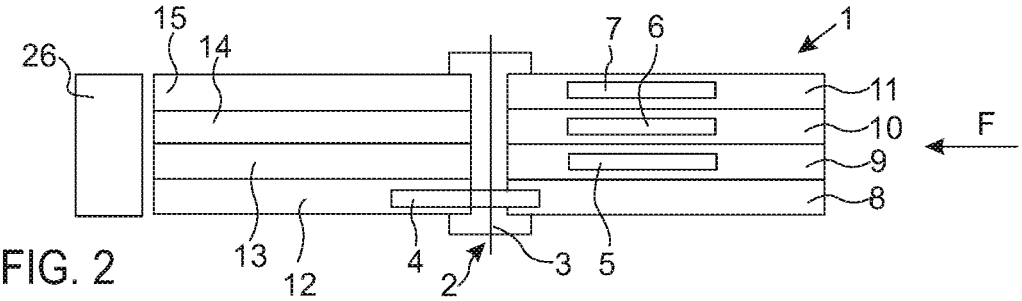
FIGS. 2-5 show the sequential supply of the respective food products through the scanner in the embodiment of the food processing apparatus according to the disclosure in plan view.

FIG. 2 shows how a first food product 4 is conveyed through the scanning area 3 of the scanner 2. For this purpose, the drive of the conveyor tracks 8 and 12 are activated by a control unit, so that the conveyor tracks 8 and 12 convey the food product 4 resting on them. In particular the first food product 4 is conveyed only on the conveyor track 8 until it reaches the scanning area 3. The food product 4 is then conveyed at substantially constant speed through the scanning area 3 and onto the downstream conveyor track 12. In this, at least one property of the food product 4 is determined with the scanner, in particular, the food product 4 is irradiated and the data thus determined is stored in dependency of the longitudinal direction of the food product 4 extending in the conveying direction F.

After the food product 4 has been entirely conveyed through the scanning area 3, it rests exclusively on the downstream conveyor track 12. When the food product 4 is located at a desired position on the downstream conveyor track 12, the drive of the conveyor tracks 8 and 12 is stopped.

The conveyor tracks 12, 13, 14, 15 are disposed on a weighing device 24, in particular a digital scale. In the present embodiment, all the downstream conveyor tracks 12, 13, 14, 15 are disposed on only one digital scale. The weight of the food product 4 is determined by the weight difference before and after conveying the food product 4 on the downstream conveyor track 12.

Figure 3:
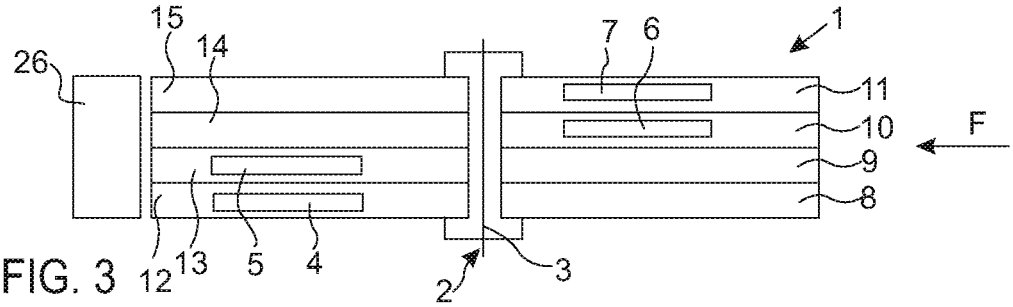

In FIG. 3, the food product 4 is arranged in its intermediate stop position on the conveyor track 12. Furthermore, the further food product 5 was already conveyed from the upstream conveyor track 9 through the scanning area 3 onto the downstream conveyor track 13, where the scanner has then determined the property of the food product 5. The digital scale being associated with the conveyor tracks 12, 13, 14, 15 then determines the weight difference from the state in which only the food product 4 rested on the conveyor track 12, to the state, as shown in FIG. 3, in which the food products 4 and 5 each rest on the conveyor tracks 12 and 13. In using the weight difference, the weight of the food product 5 can be determined.

Due to the separate drive of the conveyor tracks 12 and 13, the leading ends of the food products 4, 5 can be aligned to each other. This can occur in particular based on the properties of the food product being determined by the scanner. By using the scanner, the position of the leading ends of the food products 4, 5 can be determined with respect to the conveyor tracks 12, 13. This information can be utilized to achieve an alignment of the food products 4, 5. An alignment of the further food products 6, 7 with the food products 4, 5 can be achieved accordingly. Alternatively, a light barrier can also be provided in the region of the downstream conveyor tracks 12, 13, 14, 15, which allows an alignment of the food products 4, 5, 6, 7, in that the drive of the respective conveyor track is stopped when the leading end of a food product arrives at the light barrier.

Figure 4:
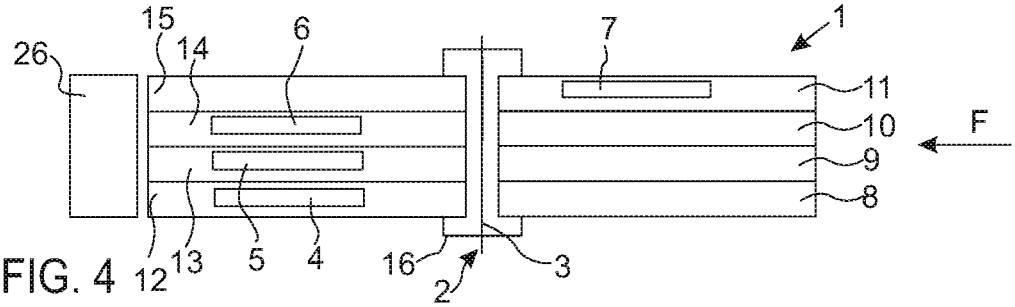

FIG. 4 shows the state of the food processing apparatus 1, in which the food product 6 was conveyed by the conveyor tracks 10, 14 through the scanning area 3 of the scanner, so that it was possible to determine its properties. The weight of the food product 6 is determined, as already described above in relation to the food product 5, by differential weight measurement, and the leading end of the food product 6 is aligned with the leading ends of the food products 4 and 5.

Finally, the final food product 7 is conveyed by the conveyor tracks 11 and 15 through the scanning area 3 of the scanner 2, so that the properties of the food product 7 can be determined.

Figure 5:
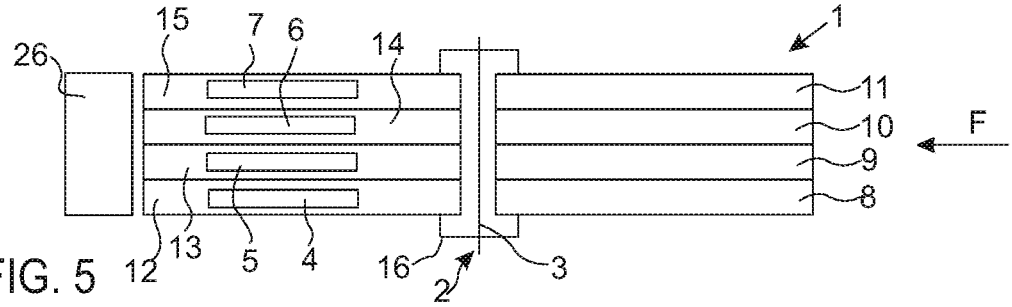

FIG. 5 illustrates the state where all the food products 4, 5, 6, 7 have passed through the scanning area 3 and can be supplied to further processing. In particular a food cutting device 26 downstream of the conveyor tracks 12, 13, 14, 15 is provided for this, which is not illustrated in the figures. Advantageously a so-called slicer is used, which simultaneously slices the food products 4, 5, 6, 7 arranged in parallel adjacent to each other with only one cutting blade, in particular a circular knife or sickle knife. The conveyor tracks 12, 13, 14, 15 of the scanner can be the feeder conveyor tracks for the slicer.

Figure 6:
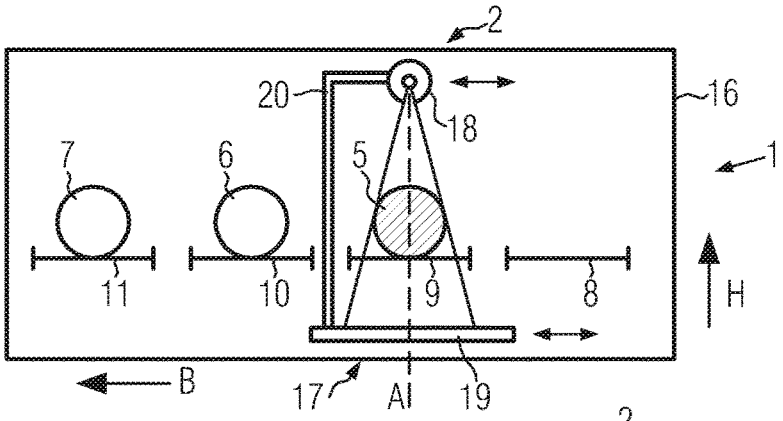
FIG. 6 shows a sectional view through the scanning area of an embodiment of a food processing apparatus according to the disclosure.

FIG. 6 shows a sectional view through the scanning area 3 of a scanner 2 in an embodiment of a food processing apparatus 1 according to the disclosure. The state shown corresponds to the state between FIGS. 2 and 3 at the point in time when the food product 5 is conveyed through the scanning area 3. The perspective in FIG. 6 is against the conveying direction F. Accordingly, the food product 4 is not shown because it is already located in front of the drawing plane, the food product 5 is shown hatched since it is precisely in the drawing plane, and the food products 6 and 7 are still on the upstream conveyor tracks 10 and 11 as shown in FIG. 3.

The scanner 2 comprises a housing 16 and a scanning unit 17 movably arranged therein. The scanning unit 17 is a radiographic device which comprises an X-ray source 18 and a detector 19. The beam axis A of the X-ray beam bundle originating from the X-ray source 18 is aligned substantially vertically. It is pointed out that the X-ray radiation fans out from the X-ray source 18. The X-ray radiation irradiates through the food product 5 and its intensity is detected by the detector 19. In particular the density of the food product 5 can be thereby be detected.

Figure 9:
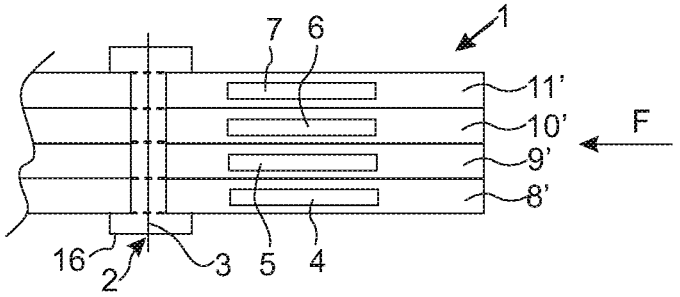
FIG. 9 shows a fragmentary plan view of an environment in which conveyor devices extend through a scanning area of a scanner.

It is pointed out that the X-ray radiation reaches the detector 19 without passing through the conveyor tracks 8, 9, 10, 11 or 12, 13, 14, 15, since a spacing is provided between the conveyor tracks, as shown in FIGS. 1 to 5. The X-ray source 18 and the detector 19 are provided in the conveying direction F precisely at the level of this spacing. Due to the fact that the food product 5 is during scanning conveyed through the scanning area 3, the density of the food product 5 can be determined along the entire longitudinal extent of the food product 5. In other embodiments, respective conveyor devices of the conveyor tracks can also extend through the scanning area. Particularly suited conveyor devices, such as belt conveyors, are provided for this, which do not shield the X-rays. FIG. 9 shows such an embodiment where conveyor tracks 8', 9', 10' and 11' extend through the scanning area 3.

The X-ray source 18 is in the present embodiment arranged above the food product 5, the detector 19 beneath. In other embodiments, however, a reverse arrangement can also be given, meaning that the X-ray source 18 can be disposed below the food product 5 and the detector 19 above the food product 5.

The scanning unit 17 comprises in particular a support 20, which connects the detector 19 and the X-ray source 18 with each other Thereby, the scanning unit 17 forms an integral component.

The scanning unit 17 is movable in the width direction B in the scanning area 3. First, the scanning unit 17 is disposed on the width of the conveyor track 8 to scan the first food product 4. Then the scanning unit 17 is moved to the position shown in FIG. 6 to scan the food product 5. In the further course, the scanning unit 17 is further moved in the width direction B to the supply track 10, and then to the conveyor track 11 to respectively scan the food products 6 and 7.

Figure 7:
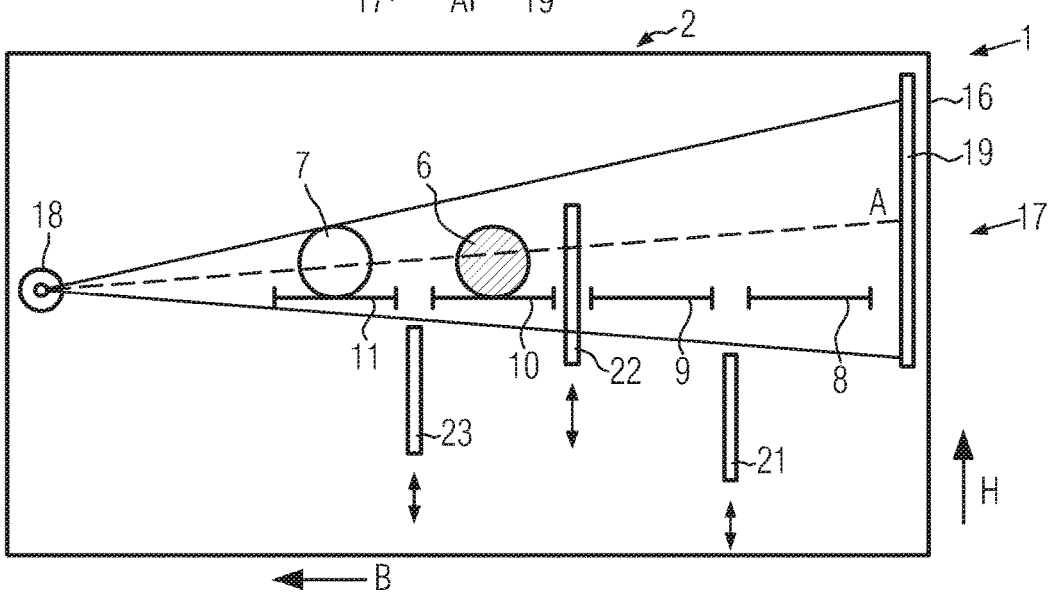
FIG. 7 shows a sectional view through the scanning area of a further embodiment of a food processing apparatus according to the disclosure.

FIG. 7 shows an alternative embodiment of the food processing apparatus according to the disclosure in a sectional view in the scanning area 3. The scanning unit 17 again comprises an X-ray source 18 and a detector 19 which, however, are in this embodiment attached in an immobile manner. The beam axis A of the X-ray beam bundle originating from the X-ray source 18 is aligned substantially horizontally. FIG. 7 shows the state in which the food products 4 and 5 were already passed through the scanning area and are resting on the downstream conveyor tracks 12 and 13, the food product 7 is arranged upstream of the scanning area 3 on the conveyor track 11, and the food product 6 is just being conveyed through the scanning area 3, so that its properties are being determined. The upstream and downstream conveyor tracks can in this embodiment each be combined to end-to-end conveyor tracks, as no spacing between the conveyor tracks is necessary because the beam path does not extend through the plane of the conveyor tracks.

In a further preferred embodiment, further detectors 21, 22, 23 can be arranged between the conveyor tracks 8, 9; 9, 10; 10, 11. In particular, the detectors 21, 22, 23 can be individually adjusted in the upper direction H. Thereby, a respective detector can, when viewed starting out from the X-ray source 18, be arranged closely behind each food product to be analyzed, so that a more accurate measurement result regarding the respective food product can be obtained. In the state of the food processing apparatus 1 in FIG. 7, the additional detector 22 is disposed closely beside the food product 6. Once the food product 7 is conveyed through the scanning area 3, the detector 23 is located closely behind the food product 7 between the conveyor tracks 11 and 10. The detectors 21, 22, 23 are all moved downwardly when the first food product 4 is analyzed starting from conveyor track 8.

However, it is pointed out that the food processing apparatus 1 according to FIG. 7 can also be designed without detectors 21, 22 and 23, so that only detector 19 is provided for all the food products.

Figure 8:
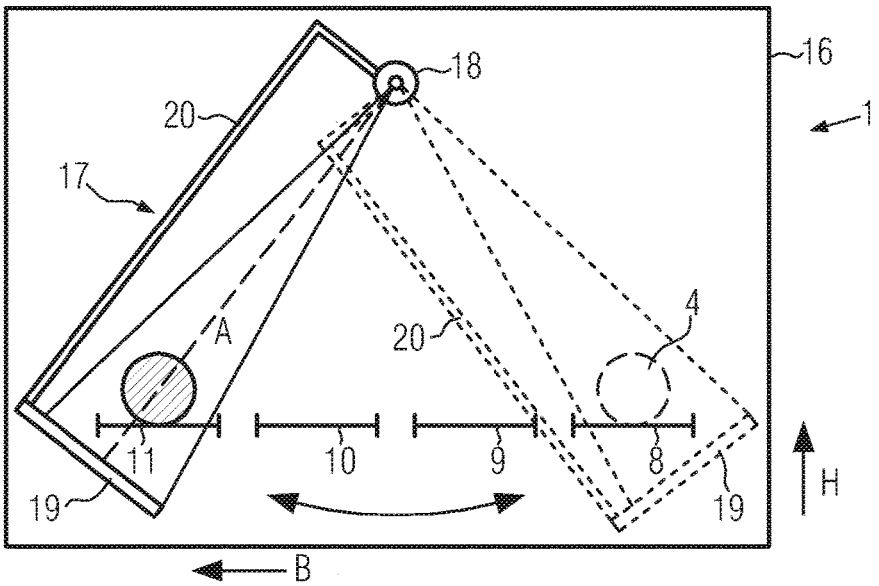
FIG. 8 shows a sectional view through the scanning area of a further embodiment of a food processing apparatus according to the disclosure.

FIG. 8 illustrates a further embodiment of a food processing apparatus according to the disclosure. In this embodiment the scanning unit 17 is pivotable. In the present embodiment, the pivot axis for the scanning unit 17 is located substantially in the area of its X-ray source 18, so that the X-ray source 18 is only rotates, whereas the detector 19 is pivoted into different positions below the respective conveyor tracks 8, 9, 10. The X-ray source 18 and the detector 19 are again connected by a support 20. The orientation of the X-ray source 18 towards the detector 19 can thereby be ensured.

FIG. 8 shows the state in which the scanning unit 17 scans the food product 7. In order to illustrate the pivoting of the scanning unit 17, a further pivot position of the scanning unit 17 for irradiating the food product 4 is shown in dashed lines. Pivoting the scanning unit 17 for scanning the food products 5, 6, which are supplied to the conveyor tracks 9, 10, is performed accordingly.

In other embodiments, the X-ray source 18 can also be not arranged in the region of the pivot axis. In particular, the pivot axis can essentially be arranged in the middle between the X-ray source 18 and the detector 19, so that both the X-ray source 18 and the detector 19 can be pivoted. In this particular case, a semi-circular C-support is in particular suggested, since it is then moved substantially along a circular path. With suitable mounting outside the pivot axis, for example on rails, it can thereby be possible that the support 20 does not need not be pivoted in the spacing between the conveyor tracks 8, 9, 10, 11 and the conveyor tracks 12, 13, 14, 15. In other embodiments, a motion of the X-ray source 18 can also be provided relative to the detector 19. A pivoting X-ray source 18, as illustrated in FIG. 8, can be combined with a detector linearly adjustable in the width direction B, as illustrated in FIG. 6.

It is also possible that a sub-group of food products is simultaneously scanned. For example, several food products can be scanned simultaneously next to each other by a common scanning unit. Alternatively, two separate scanning units can be provided to simultaneously scan the food product disposed in parallel spaced from each other. Nevertheless, the required radiation intensity of the scanning unit can be reduced and the quality of analysis can be improved in contrast to the prior art solutions, in which all of the food products are scanned simultaneously.

The invention claimed is:

1. A food processing apparatus comprising:

a scanner with a scanning unit for determining properties of food products, wherein said scanning unit comprises a radiographic device including an X-ray source and a detector;

at least two parallel, movable conveyor belts that are each separately drivable by a respective drive for supplying said food products to said scanner, said at least two parallel conveyor belts including a first conveyor belt and a second conveyor belt;

a common weighing apparatus associated with said at least two parallel conveyor belts; and a control unit for controlling said drives of said at least two parallel conveyor belts, wherein said control unit is configured to separately control said drives of said at least two parallel conveyor belts to sequentially convey at least one food product on said first conveyor belt entirely through a scanning area of said scanner and then at least one food product on said second conveyor belt entirely through said scanning area of said scanner, wherein said control unit is further configured to control said drive of said first conveyor belt in order to move said first conveyor belt at a time when said second conveyor belt remains stationary, and wherein said weighing apparatus is configured to determine weight of each of said food products via a differential weight measurement during sequential supply of said food products.

2. The food processing apparatus according to claim 1, wherein said control unit is configured to individually convey said food products through said scanning area.

3. The food processing apparatus according to claim 1, wherein said scanning unit is movable.

4. The food processing apparatus according to claim 3 wherein said scanning unit is pivotable.

5. The food processing apparatus according to claim 1, wherein said scanning unit has an upright beam axis.

6. The food processing apparatus according to claim 1, wherein a beam axis of said scanning unit is horizontal.

7. The food processing apparatus according to claim 1 further comprising a food cutting apparatus disposed downstream of said scanner, wherein said food processing apparatus is configured to simultaneously slice, using said food cutting apparatus, said at least one food product on said first conveyor belt and said at least one food product on said second conveyor belt based on properties or values determined by said scanner.

8. The food processing apparatus according to claim 1, wherein said detector is arrangeable between two of said at least two parallel conveyor belts.

9. The food processing apparatus according to claim 1, wherein said scanning unit comprises a support which is mounted pivotable about at least one of said at least two parallel conveyor belts.

10. The food processing apparatus according to claim 1, wherein a conveyor device of at least one of said at least two parallel conveyor belts extends through said scanning area.

11. The food processing apparatus according to claim 1 further comprising a third conveyor belt for supplying food products to said scanner, wherein said control unit is configured to control movement of said third conveyor belt and one of said first and second conveyor belts to provide simultaneous movement of said third conveyor belt and said one of said first and second conveyor belts.

12. The food processing apparatus according to claim 11 wherein said control unit is configured to control movement of said third conveyor belt and said first conveyor belt to provide simultaneous movement of said third conveyor belt and said first conveyor belt, and wherein said second conveyor belt is disposed between said first conveyor belt and said third conveyor belt.

13. The food processing apparatus according to claim 1 wherein each of said at least two parallel conveyor belts comprises a conveyor device that extends through said scanning area.

14. The food processing apparatus according to claim 1, wherein said first and second conveyor belts comprise first and second upstream conveyor belts, respectively, and wherein said food processing apparatus further comprises first and second downstream conveyor belts that extend downstream of said scanner, wherein said first and second downstream conveyor belts are aligned with said first and second upstream conveyor belts, respectively.

15. The food processing apparatus according to claim 1 wherein said control unit is further configured to control said drives of said first and second conveyor belts in order to align a leading end of said at least one food product on said first conveyor belt and a leading end of said at least one food product on said second conveyor belt downstream of said scanning area.

16. The food processing apparatus according to claim 1 further comprising a food cutting device positioned downstream of the scanning unit.

17. The food processing apparatus according to claim 1 wherein said control unit is configured to control said drives of said at least two parallel conveyor belts so that said at least one food product on said first conveyor belt is moved through said scanning area while said at least one food product on said second conveyor belt is not moved past a pre-scanning position upstream of said scanning area, and so that said at least one food product on said second conveyor belt is held at said pre-scanning position at a time when said at least one food product on said first conveyor belt is being moved through said scanning area.

18. The food processing apparatus according to claim 1 wherein said scanning unit comprises a pivotable X-ray source and a laterally adjustable detector.

19. The food processing apparatus according to claim 1 wherein said scanner comprises a housing which extends across said at least two parallel conveyor belts.

20. The food processing apparatus according to claim 19 further comprising a food cutting apparatus disposed downstream of said scanner, wherein said food processing apparatus is configured to slice, using said food cutting apparatus, said at least one food product associated with said first conveyor belt and said at least one food product associated with said second conveyor belt based on properties determined by said scanner.

21. The food processing apparatus according to claim 20 wherein each of said at least two parallel conveyor belts extends through said scanning area.

22. A food processing apparatus comprising:

a scanner with a scanning unit for determining properties of food products;

first and second parallel conveyor belts that are each configured to supply food products to the scanner and that are independently movable;

a first drive for driving the first conveyor belt, and a second drive for separately driving the second conveyor belt;

a third conveyor belt for supplying food products to the scanner;

a control unit for controlling the first and second drives; and a food cutting device disposed downstream of the scanner;

wherein the control unit is configured to separately control the first and second drives to sequentially convey a first food product on the first conveyor belt through a scanning area of the scanner and then a second food product on the second conveyor belt through the scanning area of the scanner, so that the first product is entirely conveyed through the scanning area before the second food product reaches the scanning area, wherein the control unit is further configured to control the drive of the first conveyor belt in order to move the first conveyor belt at a time when the second conveyor belt remains stationary, wherein the food processing apparatus is configured to simultaneously slice, using the food cutting device, the first food product and the second food product based on properties or values determined by the scanner, and wherein the control unit is configured to control movement of the third conveyor belt and one of the first and second conveyor belts to provide simultaneous movement of the third conveyor belt and the one of the first and second conveyor belts.

23. The food processing apparatus according to claim 22 wherein the control unit is configured to separately control the first and second drives so that the first food product on the first conveyor belt is moved through the scanning area while the second food product on the second conveyor belt is not moved past a pre-scanning position upstream of the scanning area, and so that the second food product on the second conveyor belt is held at the pre-scanning position at a time when the first food product on the first conveyor belt is being moved through the scanning area.

24. The food processing apparatus according to claim 22 wherein the scanning unit comprises a pivotable X-ray source and a laterally adjustable detector.

25. The food processing apparatus according to claim 22 wherein each of the first and second conveyor belts extends through the scanning area.

* * * * *